United States Patent [19]

Paridaens

[11] Patent Number: 4,868,454

[45] Date of Patent: Sep. 19, 1989

[54] COLOR CATHODE RAY TUBE WITH ELECTRON GUN PROVIDING REDUCED CONVERGENCE DRIFT

[75] Inventor: Cornelius J. H. Paridaens, Eindhoven, Netherlands

[73] Assignee: U.S. Philips Corporation, New York, N.Y.

[21] Appl. No.: 158,449

[22] Filed: Feb. 22, 1988

[30] Foreign Application Priority Data

Mar. 6, 1987 [GB] United Kingdom ..... 8705308

[51] Int. Cl.[4] ..... H01J 29/54; H01J 29/62

[52] U.S. Cl. ..... 313/412; 313/414

[58] Field of Search ..... 313/479, 414, 412

[56] References Cited

U.S. PATENT DOCUMENTS 4,564,786 1/1986 Baum et al. ..... 313/479

FOREIGN PATENT DOCUMENTS 160944 9/1984 Japan ..... 313/479
209250 11/1984 Japan ..... 313/412
228347 12/1984 Japan ..... 313/479
1727 1/1985 Japan ..... 313/412

OTHER PUBLICATIONS

"Soft-Flash Picture Tubes", by J. Gerritsen, *IEEE Transactions on Consumer Electronics,* vol. CE-24, No. 4, Nov. 1978.

*Primary Examiner*—Kenneth Wieder
*Attorney, Agent, or Firm*—Robert J. Kraus

[57] ABSTRACT

A color cathode ray tube having an in-line electron gun in which convergence drift is reduced significantly by providing conductive islands (32,34) in the form of metal mirrors on the internal wall of the neck. The islands (32,34) are located on and about the plane of the electron beams and face only the higher voltage one of the main focusing electrodes (g3,g4). The islands (32,34) float electrically. Additionally convergence stability can be improved by providing a ring or strip (36) about the external surface of the neck in the vicinity of the gap between the focusing electrodes (93,94), which ring or strip (36) is connected to a point of fixed potential such as ground.

9 Claims, 2 Drawing Sheets

COLOR CATHODE RAY TUBE WITH ELECTRON GUN PROVIDING REDUCED CONVERGENCE DRIFT

BACKGROUND OF THE INVENTION

The present invention relates to a color cathode ray tube having an envelope comprising a display window, a cone and a neck, a cathodoluminescent screen provided interiorly of the display window, a shadow mask adjacent to, but spaced from, the screen, a triple beam in-line electron gun system comprising at least a first low voltage focusing electrode (or electrodes) and a second high voltage focusing electrode (or electrodes) being separated from each other, and electrically conductive areas provided on the interior of the neck wall.

Such a color cathode ray tube is known from Japanese Kokai 59-228347.

In an in-line electron gun, particularly a gun in which corresponding electrodes are implemented as unitary electrodes, the various juxtaposed electrodes are held together by glass beads disposed on opposite sides of a plane containing the beam paths of the three electron beams. Viewed in cross section the glass beads can be regarded as being arranged north and south and the plane may be regarded as extending east-west. In the case of the electron gun including a bipotential focusing lens then this lens is constituted by two back-to-back arranged cup-like electrodes. The first, lower voltage electrode, generally called g3; may be at 8 kV and the second, higher voltage electrode, generally called g4, may be at 25 kV. The facing surfaces of the first and second electrodes are separated by a gap of the order of 1 mm.

Convergence drift in color cathode ray tubes having such electron guns is a well-known but not fully understood problem. This problem appears as a result of the variation in the neck potential, which variation is caused by the condition of the outside surface of the neck glass at switch-on of the high tension voltage. The initial neck potential is increased by the building-up of the neck charge due to the beam current. This building-up of the neck charge is visible as a growing misconvergence of the electron beams.

Various proposals for reducing convergence drift include increasing the size of the dam, that is, increasing in the east-west direction the extent of the electrode surface between its outer edge and the nearest aperture. In so doing the influence of the wall voltage on the lens fields is reduced. Another proposal is to reduce the size of the gap between the facing surfaces of the lens electrodes. While this will reduce the influence of the wall voltage on the lens fields it has the disadvantage that as a result of the close proximity of these electrodes stray, cold emissions are produced by the lower voltage focusing electrode. As the present day trend is to enlarge the gap to avoid the production of cold emissions, this option is not acceptable.

Japanese Kokai 59-228347 proposes eliminating convergence drift by providing metallic conductive coatings on the internal wall of the neck opposite the gap between the fifth and sixth electrodes forming the principal focusing lens of the electron gun. While such conductive coatings reduce convergence drift, they will not eliminate this problem. Additionally the production of these conductive coatings, usually as metallic mirrors, generally takes place naturally during spot-knocking when very high voltages, up to 80 kV, are applied to electrodes of the electron gun. However the extent and quality of these metallic mirrors are dependent on the activity which takes place during spot-knocking. As the level of this activity varies from tube to tube it is unpredictable and in consequence the quality and repeatability of these metallic mirrors is variable and unacceptable for volume production. Furthermore this method of producing metallic mirrors is not usable in so-called "soft-flash" cathode ray tubes because the energy available during a flash-over when spot knocking is limited due to the presence of the relatively high resistance of the internal layer provided in such tubes. Thus no conductive coatings in the form of metallic mirrors will be formed during spot knocking.

Providing metallic coatings opposite the gap between the lens electrode before the spot-knocking operating stage is not a solution because during spot knocking the metallic coatings can be damaged. Also pitting of the neck glass may occur causing loose glass particles to be deposited on the lens electrodes, which particles may comprise cold emission sources. Pitting may also lead to undesired cracking of the neck glass.

SUMMARY OF THE INVENTION

An object of the present invention is to reduce significantly the convergence drift in in-line electron gun color cathode ray tubes.

According to the present invention there is provided a color cathode ray tube having an envelope comprising a display window, a cone and a neck, a cathodoluminescent screen provided interiorly of the display window, a shadow mask adjacent to, but spaced from, the screen, a triple beam in-line electron gun system comprising at least a first low voltage focusing electrode (or electrodes) and a second high voltage focusing electrode (or electrodes), the facing surfaces of the first and second electrodes being separated from each other, and electrically conductive areas provided on the interior of the neck wall, characterized in that the conductive areas are confined to the neck wall portion facing the second focusing electrode(s) and form diametrically arranged islands which lie on the line of interception of the plane containing the axes of the electron beams with the neck.

Investigative tests on color cathode ray tubes having bipotential focusing lenses with the gap between the facing surfaces of the lens electrodes being larger than normally used, say 1 mm, has shown that conductive islands on the internal surface of the tube neck, located east and west of the higher voltage lens electrode, that is the accelerating lens electrode, can be very effective in correcting potential variations causing convergence drift. It is preferred that the conductive islands do not extend axially beyond the limits of the higher voltage lens electrode, but in the event of their being large enough to extend to opposite the gap between the lens electrodes, then no additional benefit to that already obtained is expected.

In the case of a soft flash color cathode ray tube the electrically conductive areas which will normally comprise metal mirrors can be formed using lasers which evaporate a microscopic amount of the metal of the second lens electrode or alternatively can be formed by evaporating a metal, say an alloy of chromium and iron, using an RF heating process.

The provision of the conductive islands opposite the higher voltage one of the lens electrodes has corrected for potential variations on the inside of the neck. However this leads to a new problem which is still related to the condition of the outside of the neck glass at switch-on. It has been noted that if the external surface condition of the neck glass is relatively moist due to say condensation, then the potential on the inside surface of the neck glass stabilizes at a considerably lower voltage than if the neck glass is dry. This leads to a different convergence situation which remains stable during the time when the television receiver or video display unit is switched-on. To prevent different stable convergence situations occurring as a result of variations in the condition of the external surface of the neck, the outside of the neck glass near the main lens should be fixed at a fixed potential. This may be achieved by providing a conductive ring or strip externally of the tube neck in the vicinity of the main focusing lens, which ring or strip is connected to a fixed voltage or to ground (via an external conductive coating on the cone).

BRIEF DESCRIPTION OF THE DRAWING

The present invention will now be described, by way of example, with reference to the accompanying drawing figures, wherein.

In the drawing figures, corresponding reference numerals have been used to indicate the same parts.

DESCRIPTION OF THE PREFERRED EMBODIMENT

Figure 1:
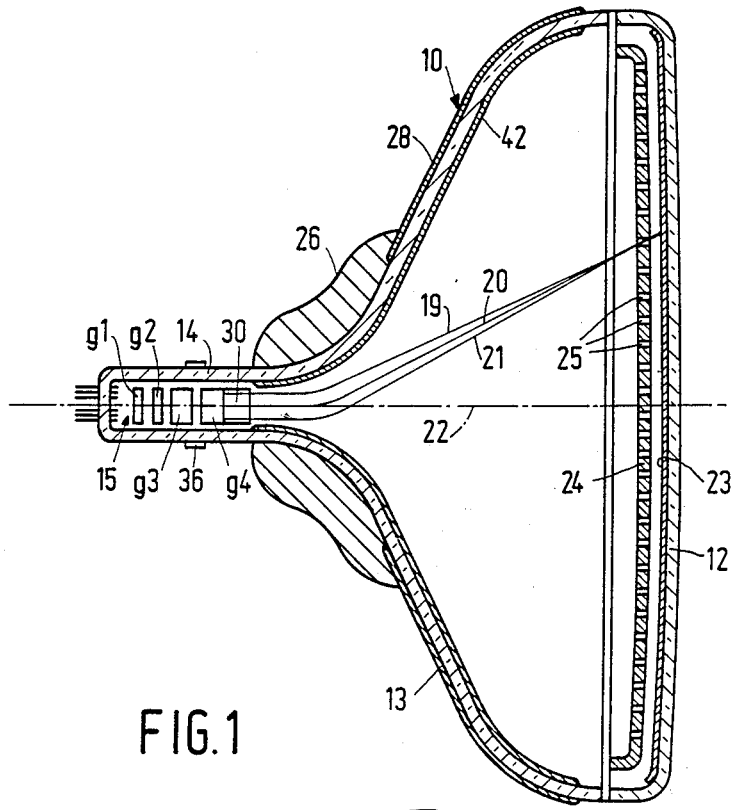
FIG. 1 is a diagrammatic horizontal cross-sectional view through an embodiment of an in-line gun colour cathode ray tube made in accordance with the present invention.
Figure 3:
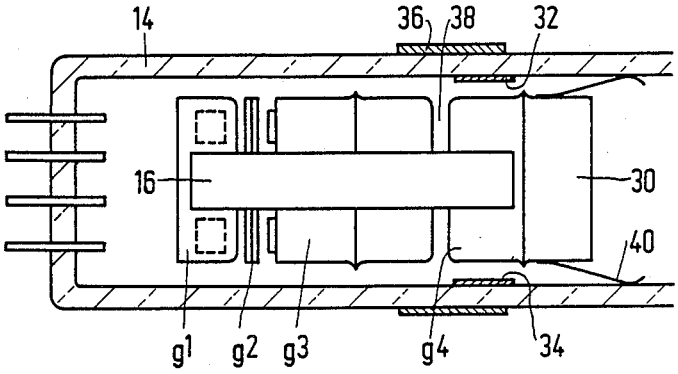
FIG. 3 is a diagrammatic view looking in the north-south direction at an electron gun having a bipotential main focusing lens.
Figure 4:
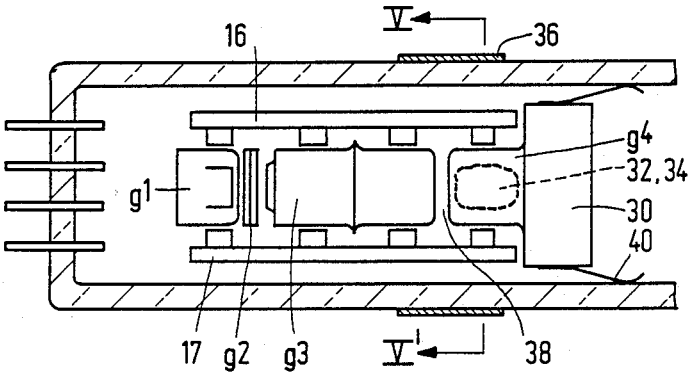
FIG. 4 is a view perpendicular to that shown in FIG. 3.
Figure 5:
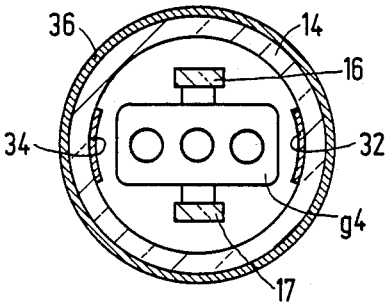
FIG. 5 is a view on the line V—V' in FIG. 4.

The color cathode ray tube shown in FIG. 1 comprises a glass envelope 10 which is composed of a display window 12, a cone 13 and a neck 14. An electron gun system 15 is provided in the neck 14, which system comprises three in-line arranged electron guns formed by separate cathodes and four unitary grid electrodes g1, g2, g3 and g4 juxtapositioned by glass beads 16, 17 (FIGS. 3 to 5). The electron gun system 15 generates three electron beams 19, 20 and 21, respectively, with their axes situated in one plane (the plane of the drawing) which plane for convenience of description may be termed the east-west plane. In the electron gun system 15 the axis of the central electron beam 20 coincides with the tube axis 22. The display window 12 comprises on its inside a plurality of triplets of phosphor lines. Each triplet comprises a line consisting of a blue-luminescing phosphor, a line consisting of a green-luminescing phosphor, and a line consisting of a red-luminescing phosphor. All the triplets together constitute the display screen 23. The phosphor lines are substantially perpendicular to the plane of the drawing. Positioned in front of the display screen 23 is a shadow mask 24 in which a plurality of elongate apertures are provided through which the electron beams 19,20 and 21 pass and impinge only upon phosphor lines of one color. The three electron beams situated in one plane are deflected by a system of deflection coils 26.

A conductive film 28 is provided on the external surface of the cone 13. Optionally for a soft flash tube a resistive layer 42 is provided on the internal surface of the cone and extends into the neck to the vicinity of a centering cup 30, to which the layer is electrically connected by springs 40 (FIGS. 3 and 4) attached to the cup 30.

Within the neck, conductive islands 32,34 (FIGS. 3 to 5) are provided on the internal surface of the neck 14 adjacent the grid g4 on and about the east-west plane containing the electron beams 19,20,21.

Optionally an electrically conductive ring or strip 36 is provided around the external surface of the neck 14 near the gap 38 between the main, bipotential focusing lens electrodes g3, g4. The purpose of the ring or strip 36 is to stabilize the convergence of the electron beams against variations in the external condition of the neck 14 at switch-on.

The electron gun system 15 may alternatively consist of three individual electron guns.

Figure 2:
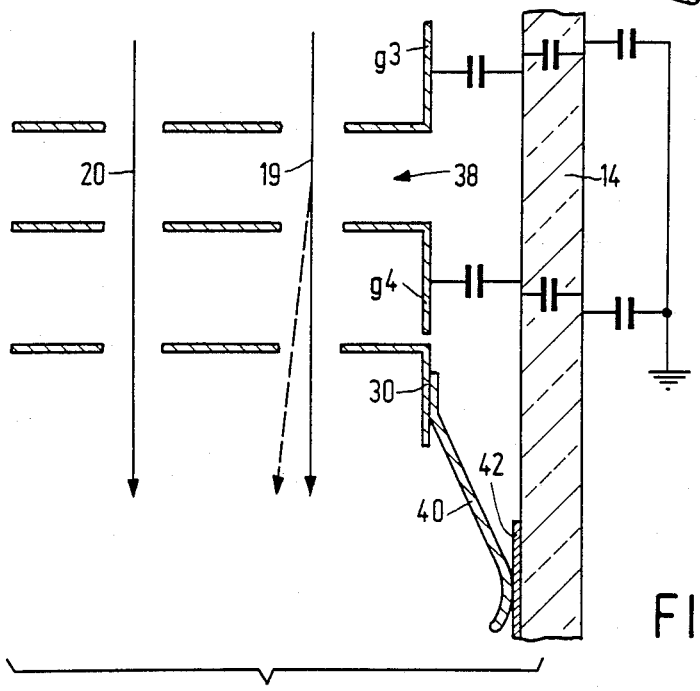
FIG. 2 is a diagram explaining the convergence drift problem as presently understood.

Referring to FIG. 2, the drawing shows a part of an in-line electron gun system, more particularly the bipotential lens formed by the electrodes g3, g4 and the centering cup 30 connected by spring contacts 40 to the resistive layer 42 on the inside of the cone 13 and extending part way into the neck 14. No means have been shown to prevent convergence drift or stabilize convergence. In operation the grid g3 is typically at 8 kV and the grid g4 is typically at 25 kV. At switch-on, a potential builds-up rapidly on the internal surface of the neck 14 due to a capacitive coupling between the electrode g3,g4 and the internal surface. As the glass of the envelope is a dielectric and the external surface of the neck is capacitively coupled to ground or to another convenient voltage reference point, then a potential builds-up very rapidly on the external surface of the neck 14 at switch-on.

However an unstable condition prevails, especially immediately following switch-on, because as a result of beam current there is an additional slow potential build-up on the internal surface which causes the convergence of the outer electron beams 19 and 21 to drift from say the broken line condition to the acceptable full-line condition. Assuming the condition of the external surface of the neck to be dry then in the stable condition a voltage of about 18 kV has built-up on the internal surface of the neck 14. This voltage affects the focusing lens field particularly that associated with the nearest electron beam 19 (or 21) because the electron gun system 15 is asymmetrical. However because it is stable the convergence remains unchanged.

The problem of convergence drift can be reduced significantly by providing conductive islands formed by the metal mirrors 32,34 on the internal surface of the neck on either side of the grid g4 and lying on and about the east-west plane. The presence of these metal mirrors 32,34 enables the potential on the surface of the neck 14 to stabilize rapidly and remain stable. The size of the metal mirrors 32,34 can be relatively small, it not being nessary for them to be present on the part of the internal surface opposite the gap 38. The metal mirrors 32,34 float electrically and are not at any fixed voltage.

The metal mirrors 32,34 can be formed by evaporating a microscopic amount of the metal of the grid g4 onto the adjacent internal surface of the neck. Another way of forming the metal mirrors 32,34 is to evaporate a metal, such as chromium-iron, using a RF heating process. The metal can be in the form of a loop carried by the electron gun on and about the position of the grid g4. Neither of these processes relies on very high voltage being generated and therefore is suitable for use with soft flash cathode ray tubes.

Having corrected for potential variations on the inside of the neck by the provision of the conductive islands 32, 34 another effect influencing convergence is the condition of the external surface of the neck 14 in the vicinity of the lens gap 38. If the external surface is dry and the degree of dryness is of the same order as existed when the tube convergence was set-up then the potential of say 18 kV will be present on the internal surface of the neck in the vicinity of the gap 38. If however due to say condensation; the external surface of the relevant area of the neck is moist then instead of the internal surface of the neck in the vicinity of the neck being stable at 18 kV, it stabilizes at a much lower voltage of say 4 kV, which voltage appears to prevail throughout the time during which the tube is switched-on. The lower voltage has less influence on the lens field and the convergence condition is different from that set-up.

The problem of convergence stability being affected by the condition of the external surface of the neck can be overcome by the ring or strip 36 provided externally of the neck in the vicinity of the gap 38, the ring or strip 36 being connected to a point at a fixed potential, for example the outer layer 28. The ring or strip 36 may comprise a non-magnetic metal band or a non-magnetic conductive layer deposited by any suitable known technique, for example by extending the outer layer 28 on the cone 13 in a manner so as to minimize the risk of voltage breakdown by the deflection coils 26 (FIG. 1). By taking this measure the neck potential is fixed and the convergence is independent of the condition of the outer surface of the neck.

What is claimed is:

1. In a color cathode ray tube comprising an envelope having a longitudinal axis and containing a luminescent screen and a shadow mask axially-spaced from the screen, said envelope including a neck portion in which is disposed an electron-beam-producing means for producing a plurality of electron beam lying in a single plane intersecting the neck portion and directed toward convergence at the shadow mask, said electron-beam-producing means including first and second axially-spaced focusing electrodes for focusing the beams at the screen, said second focusing electrode having first and second axially-extending sidewalls intersected by the plane and operating at a higher voltage than the first focusing electrode, characterized in that the envelope includes first and second conductive layers disposed on respective inner surfaces of the neck portion intersected by the plane, each of said layers extending essentially over the respective underlying sidewall of the second focusing electrode and being electrically insulated from said second focusing electrode.

2. A cathode ray tube as in claim 1 where the extension of each of the conductive layers in the axial direction is limited to substantially the axial extension of the respective underlying sidewall of the second focusing electrode.

3. A cathode ray tube as in claim 1 where each of said layers extends substantially congruently over the respective underlying sidewall of the second focusing electrode.

4. A cathode ray tube as in claim 1, 2 or 3 where the first and second focusing electrodes form a bipotential focusing lens.

5. A cathode ray tube as in claim 1, 2 or 3 where the first and second conductive layers comprise metallic mirrors.

6. A cathode ray tube as in claim 1, 2 or 3 where the first and second conductive layers comprise metal derived from the second focusing electrode.

7. A cathode ray tube as in claim 1, 2 or 3 where the first and second conductive layers comprise evaporatively-deposited metal.

8. A cathode ray tube as in claim 1, 2, or 3 including a conductive layer disposed on an external surface of the neck portion and axially positioned adjacent a gap between the first and second focusing electrodes, said layer being electrically connected for operating at a fixed voltage.

9. A cathode ray tube as in claim 1, 2 or 3 where said tube comprises a soft flash tube having a resistive layer disposed on an inner surface of a conical portion of the envelope attached to said neck portion.

* * * * *